US006002077A

United States Patent [19]

Nicolosi

[11] Patent Number: 6,002,077

[45] Date of Patent: Dec. 14, 1999

[54] PERCUSSION IMPLEMENT

[76] Inventor: Kathy Lord Nicolosi, 58 Bay 17th St., Brooklyn, N.Y. 11214

[21] Appl. No.: 08/431,798

[22] Filed: Apr. 21, 1995

Related U.S. Application Data

[63] Continuation of application No. 08/128,832, Sep. 29, 1993, abandoned, which is a continuation of application No. 07/675,507, Mar. 27, 1991, abandoned.

[51] Int. Cl.[6] ..... G10D 13/02

[52] U.S. Cl. ..... 84/422.4; 84/422.1

[58] Field of Search ..... 84/422.4, 422.1, 84/422.2

[56] References Cited

U.S. PATENT DOCUMENTS

| | | | |
|---|---|---|---|
| 3,420,134 | 1/1969 | Cordes | 84/422.4 |
| 4,535,671 | 8/1985 | Stromberg et al. | 84/422.4 |
| 4,570,527 | 2/1986 | Pruitt | 84/422.4 |
| 4,590,839 | 5/1986 | Liedtke et al. | 84/422.4 |

*Primary Examiner*—Robert E. Nappi

*Attorney, Agent, or Firm*—Levisohn, Lerner, Berger & Langsam

[57] ABSTRACT

There is disclosed a percussion implement comprised of a bundle of a plurality of cylindrically-shaped rod members having outer rod members symmetrically positioned about a like-sized inner rod member held at one end in a close-packed relationship by a handle member and including a movable sleeve member positioned about the closely-packed bundle of rod members remote from the handle member and capable of manual axial movement thereabout to any position of the bundle of rod members to thereby achieve different sound quality and effects.

3 Claims, 1 Drawing Sheet

PERCUSSION IMPLEMENT

CROSS-REFERENCE TO RELATED APPLICATIONS

This application is a continuation of Ser. No. 08/128,832, filed Sep. 29, 1993 (now abandoned), which is a continuation of Ser. No. 07/675,507, filed Mar. 27, 1991 (now abandoned).

BACKGROUND OF THE INVENTION (a) Field of the Invention

This invention relates to musical implements and more particularly to a percussion implement for impacting a percussion instrument, such a a drum.

(b) Description of the Prior Art

Percussion instruments require the use of beaters to effect vibration of the head stretched over a generally cylindrically-shaped body constituting a drum or percussion instrument. Such beaters usually include paired unitary wooden members, brushes comprised of fine wire members, etc. In U.S. Pat. No. 4,570,527 to Pruit, there is disclosed a beater formed of a cluster of wooden rods secured together at one end and free of restraint at the other end to form a brush-like beater member to obviate certain disadvantages of fine wire brushes of the prior art. Such beater member employed rods of from 0.1 to 0.187 inches in diameter collected in a plastic handle member. While such beaters member provided a resonating sound as a function, inter alia, of rod length and sizes, etc., such beaters provided a specific sound effect.

OBJECTS OF THE PRESENT INVENTION

An object of the present invention is to provide a percussion implement capable of diverse sound quality when used on a percussion instrument.

A further object of the present invention is to provide a novel percussion implement of variable sound quality resulting from differences in vibration and/or reverberation capabilities.

Still another object of the present invention is to provide a novel percussion implement of variable sound quality capable of facile manual gripping.

SUMMARY OF THE PRESENT INVENTION

These and other objects of the present invention are achieved by a percussion implement comprised of a bundle of a plurality of cylindrically-shaped rod members having outer rod members symmetrically positioned about a like-sized inner rod member held at one end in a close-packed relationship by a handle member and including a movable sleeve member positioned about the closely-packed bundle of rod members remote from the handle member and capable of manual axial movement thereabout to any position of the bundle of rod members to thereby achieve different sound quality and effects.

BRIEF DESCRIPTION OF THE DRAWINGS

The invention will be more clearly understood by reference to the following description of an exemplary embodiment thereof when taken with the accompanying drawing wherein.

DETAILED DESCRIPTION OF THE INVENTION

Figure 1:
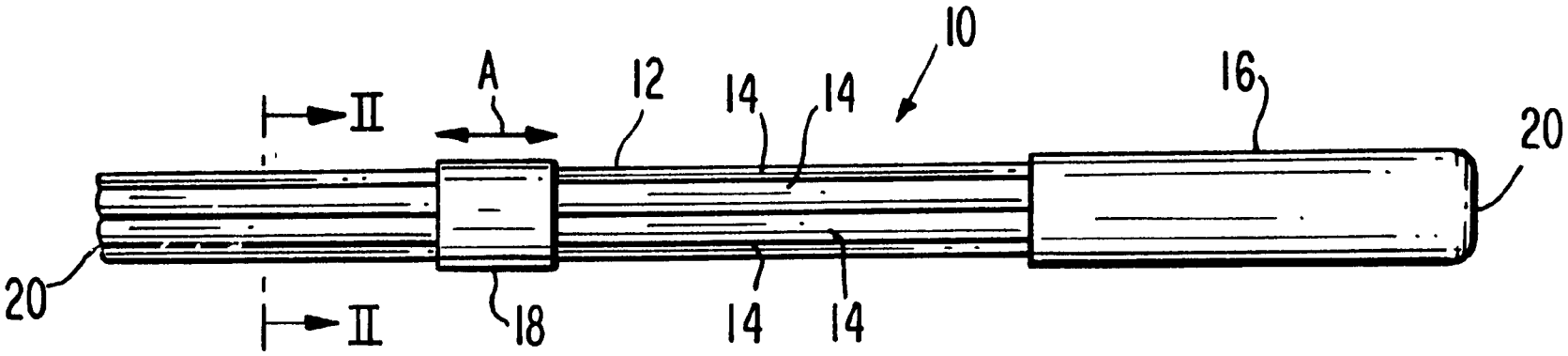
FIG. 1 is an elevational view of the percussion implement of the present invention.

Referring now to the drawing, there is illustrated a percussion instrument of the present invention, generally indicated as 10, comprised of a bundle 12 of a plurality of rod members 14 disposed within a cylindrically-shaped hollow handle member 16 and having a cylindrically-shaped sleeve member 18 positioned about the bundle 12 for manual axial movement, as illustrated by the arrow A.

Figure 2:
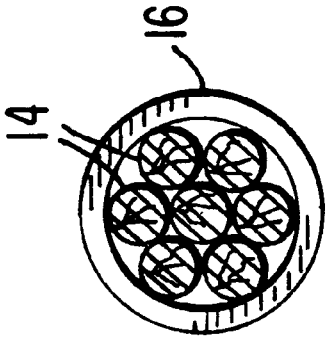
FIG. 2 is an enlarged cross-sectional view thereof taken along the line II—II of FIG. 1.

The rod members 14 are preferably elongated cylindrically-shaped wooden dowels of ¼" diameter and of a length of from 12 to 18", preferably 16", however may be formed of a material other than wood, e.g. plastic or the like. The rod members 14 are arranged in close-packed relationship, referring to FIG. 2 having a centrally positioned inner rod member 14 about which are radially-disposed outer rod members 14 in surface contact with the inner rod member 14 and adjacent rod members 14 when particularly positioned within the handle member 16. An end of the bundle 12 of the rod members 14 are positioned within the cylindrically-shaped handle member 16 having an end wall portion 20. The inner diameter of the handle member 16 is selected to firmly position the bundle 12 of the rod members 14 therein such that manual removal of the handle member 16 from the bundle 12 of rod members 14 is essentially impossible.

The handle member 16 is formed of a suitable plastic material, such as polypropylene or the like, and may be heat shrunk on the ends of the bundle 12. The length of the handle member 16 is dimensioned to constitute at least about 25 percent of the length of the rod members 14 up to about 40 percent of the length of the rod members 14 to provide for convenient manual gripping with minimal potential for slippage.

The sleeve member 18 may be formed of a like plastic material and is generally of a length of about 0.5 to 1.5 inches, or about 3 to 6 percent of the length of the bundle 16. The inner diameter of the sleeve member 18 is selected to permit the sleeve member 18 to be readily moved axially up and down the bundle 12 from an end distal to the handle 16 to a position proximate the handle 16. Notwithstanding a distal end positioning of the sleeve member 18, where the handle member 16 of the percussion implement may function as a mallet, the frictional forces between the inner surface of the sleeve member 18 and the outer surfaces of the radially disposed outer rod members 14 of the bundle 12 are adequate to prevent slippage of the sleeve member 18 off the bundle 12 while in use in such a mallet configuration.

In use, the sleeve member 18 may be moved up and down the bundle 12 thereby effecting differences in vibration and/or reverberation of the rods hitting together or selectively on a drum head of a percussion instrument. Thus, in a distal end position to the handle 16 of the sleeve member 18 on the bundle 12, the rod members 14 are closely held at the distal end thereby producing stronger/louder sound whereas positioning of the sleeve member 18 proximate the handle member 16 permits slight separation at the distal end of the rod members 14 when striking a drum head thereby providing a softer/lighter sound. Consequently, a percussion implement of the present invention particularly in paired usage on the head of a percussion instrument permits usage in a wider variety of musical styles obviating the availability of a plurality of pairs of diverse drum sticks or percussion implements to achieve like results.

In a particularly preferred form of the present invention, a distal end portion of the bundle the rod members 14 opposite the handle member 16 are preferably formed, such as by sanding to generally rounded end portion or tip 20.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

What is claimed is:

1. A percussion implement, which comprises:

a bundle of a plurality of wooden outer rod members of a diameter of about ¼ inches radially disposed about a centrally-disposed wooden inner rod member of a diameter of about ¼ inches, each of said outer rod members being in contact with said centrally-disposed inner rod member and adjacent ones of said outer rod members along said bundle;

a hollow handle member positioned about an end of said bundle; and a sleeve member positioned about said bundle and having an inner diameter dimensioned for axial movement on said bundle, said inner diameter of said sleeve member dimensioned to develop a frictional force with outer surface portions of said radially disposed outer rod members to prevent slippage of said sleeve member from said bundle in use of said percussion instrument, said sleeve member being movable along said bundle from said handle member to a distal end of said bundle for providing a different sound during usage of said percussion instrument selective positioning of said sleeve member about said bundle, said distal end of said bundle being formed with a rounded configuration.

2. A percussion implement as defined in claim 1 wherein said rod members are of a length of from about 12 to 18 inches.

3. A percussion implement as defined in claim 2 preferably 16 inches.

* * * * *